US006501922B2

(12) United States Patent
Ihara et al.

(10) Patent No.: US 6,501,922 B2
(45) Date of Patent: Dec. 31, 2002

(54) IMAGE FORMING APPARATUS WITH A HOUSING DIFFUSING OZONE

(75) Inventors: Mitsuo Ihara, Osaka (JP); Yukihiro Ito, Osaka (JP); Hiroaki Iwasaki, Osaka (JP); Yukikatsu Imanaka, Osaka (JP); Koji Kuramashi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/542,868

(22) Filed: Apr. 4, 2000

(65) Prior Publication Data

US 2002/0057921 A1 May 16, 2002

(30) Foreign Application Priority Data

Apr. 14, 1999 (JP) ..... 11-107063

(51) Int. Cl.[7] ..... G03G 21/00
(52) U.S. Cl. ..... 399/92; 399/93
(58) Field of Search ..... 399/91, 92, 93

(56) References Cited

U.S. PATENT DOCUMENTS 4,540,268 A * 9/1985 Toyono et al. ..... 399/93
4,853,735 A * 8/1989 Kodama et al. ..... 399/93
5,038,174 A * 8/1991 Kato et al. ..... 399/92
5,081,496 A * 1/1992 Takeda ..... 399/92
5,376,994 A * 12/1994 Mama et al. ..... 399/93
5,612,768 A * 3/1997 Kim et al. ..... 399/92

FOREIGN PATENT DOCUMENTS

| | | | |
|---|---|---|---|
| JP | 61-23168 | * | 1/1986 |
| JP | 61-46832 | | 10/1986 |
| JP | 63-43167 | | 2/1988 |
| JP | 2-12169 | * | 1/1990 |
| JP | 2-46456 | * | 2/1990 |
| JP | 2-105172 | * | 4/1990 |
| JP | 3-29651 | | 9/1991 |
| JP | 3-92651 | | 9/1991 |
| JP | 6-14216 | | 2/1994 |
| JP | 6-161198 | | 6/1994 |
| JP | 9-50214 | * | 2/1997 |

* cited by examiner

*Primary Examiner*—Susan S. Y. Lee
(74) *Attorney, Agent, or Firm*—Smith, Gambrell & Russell, LLP

(57) ABSTRACT

In a copying machine 1 which is an image forming apparatus according to the present invention, an air fan 11 and an air duct 12 on the downstream side thereof are provided in a housing 10, to lead an air current to an opening 55*a* of an image forming unit 5 through the air duct 12. The opening 55*a* is for passing a light beam from a light irradiating unit 4, and is also used for blowing off air, to lead the air current to the photosensitive drum 51. A rib 10*g* is provided in the vicinity of the opening 55*a* in the housing 10, to efficiently guide the air current to the opening 55*a* without varying the air current. The air current disperses ozone or the like in an area surrounding the photosensitive drum 51.

1 Claim, 4 Drawing Sheets

IMAGE FORMING APPARATUS WITH A HOUSING DIFFUSING OZONE

The application is based on an application No. 11-107063 filed in Japan, the content of which is incorporated hereinto by reference.

BACKGROUND OF THE INVENTION

1. Field of the Invention

The present invention relates generally to image forming apparatuses such as an electrostatic copying machine, a facsimile, and a printer. More particularly, it relates to image forming apparatuses utilizing corona discharges for forming an image.

2. Description of the Related Art

An image forming apparatus such as an electrostatic copying machine is provided with a charging corona discharger for charging a photosensitive drum in order to produce an electrostatic latent image on the photosensitive drum. In the charging corona discharger, corona discharges are induced.

When the corona discharges are induced, ozone or a nitrogen oxide ($NO_x$) is generated. The ozone or the like may degrade the photosensitive drum, resulting in the possibility that a good image cannot be formed.

In order to prevent the photosensitive drum from being degraded, it is considered that an ozone removing device is provided. For example, an air shielding plate provided in an area surrounding the photosensitive drum and suction means for sucking in air from the area surrounding the photosensitive drum, so that air including ozone can be sucked in and removed from the area surrounding the photosensitive drum (see JP-A-61-23168).

When the air shielding plate is provided, as described above, the size of the image forming apparatus is made large. Further, jam processing is difficult to perform. Accordingly, the construction of the apparatus becomes complicated. Further, air is sucked in from the whole area surrounding the photosensitive drum, so that the size of a fan for sucking in the air must be made large in order to efficiently remove the ozone.

SUMMARY OF THE INVENTION

An object of the present invention is to solve the above-mentioned technical problems, and to provide an image forming apparatus capable of efficiently preventing a photosensitive drum from being degraded by ozone or the like in simple construction.

In the present invention, ozone or a nitrogen oxide generated when a charging corona discharger induces corona discharges in order to charge the surface of a photosensitive drum does not stay in an area surrounding the photosensitive drum. Therefore, the image forming apparatus is so constructed that an air current is formed toward the circumference of the photosensitive drum. The air current is formed by a mechanism comprising an air fan, an air duct, and preferably a guiding member.

When air flows into the area surrounding the photosensitive drum, and the air is further diffused into a housing from the area surrounding the photosensitive drum, to flow out of the housing, the ozone or the nitrogen oxide does not stay in the area surrounding the photosensitive drum.

Particularly, the ozone or the nitrogen oxide generated in the area surrounding the photosensitive drum can be removed from the area surrounding the photosensitive drum more easily than it is removed by suction.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
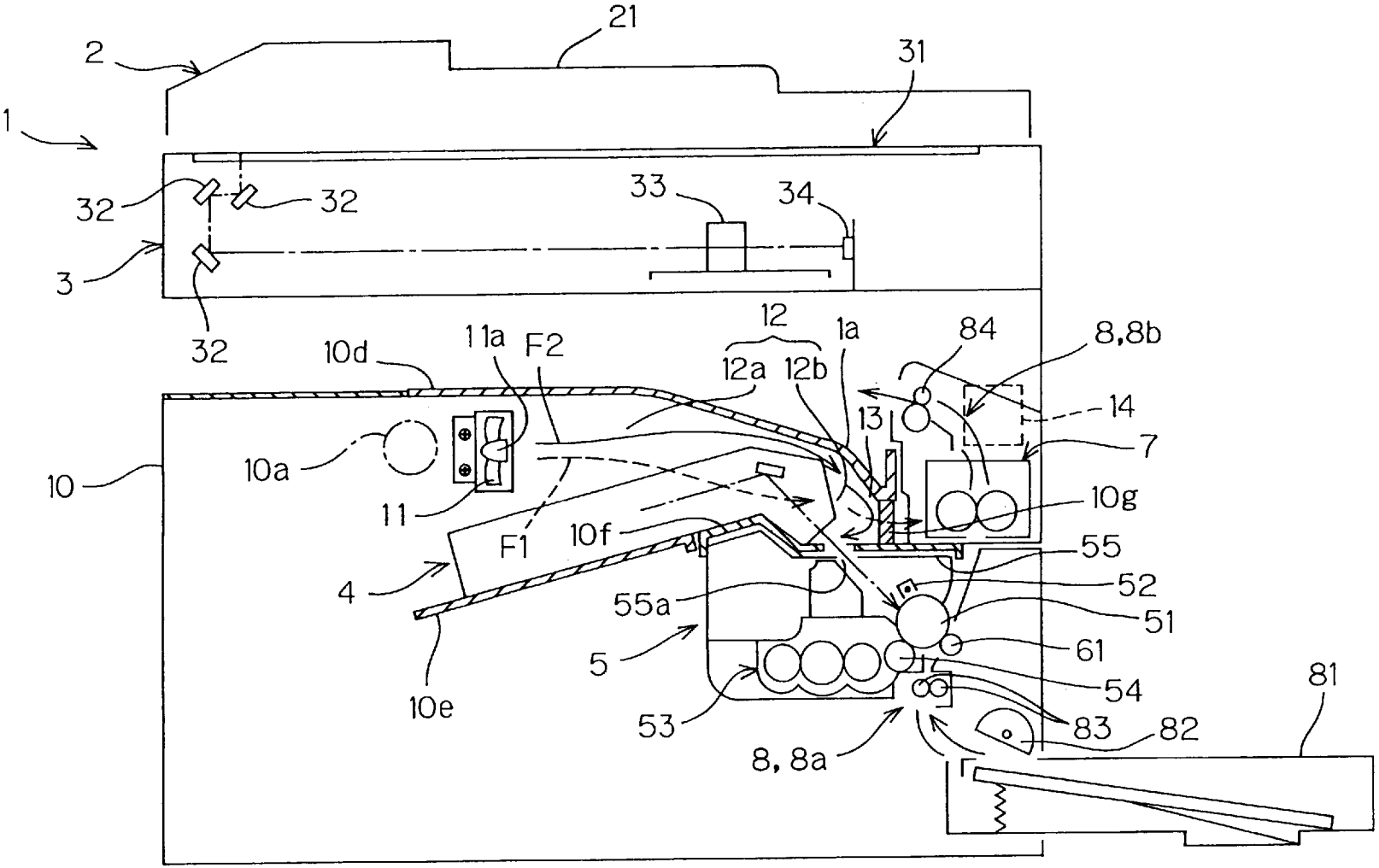
FIG. 1 is a front sectional view of the schematic construction of a copying machine according to an embodiment of the present invention.

FIG. 1 is a front view showing the schematic construction of a copying machine serving as an image forming apparatus according to an embodiment of the present invention.

A copying machine 1 has an original feeding section 2 and a reading section 3 in its upper part. The original feeding section 2 is mounted on an upper surface of a transparent platen 31 such that it can be rotatably opened or closed, to automatically deliver documents original which are held in a holding section 21 on the upper surface one at a time, and feed the document original into a paper discharging section through the transparent platen 31. The reading section 3 illuminates and scans the document original which passes through the transparent platen 31 by the original feeding section 2, to direct light reflected from the document original to a light receiving element 34 by an optical system such as mirrors 32 and a lens 33. The light receiving element 34 converts the reflected light into an electric signal. A signal from the reading section 3 is outputted upon being subjected to predetermined processing by a signal processing section (not shown).

The following elements are provided inside a lower housing 10 in the copying machine 1: that is, a light irradiating unit 4 for outputting a laser beam based on a signal from the signal processing section; an image forming unit 5 comprising a photosensitive drum 51 for forming a latent image corresponding to light from the light irradiating unit 4, a charging corona discharger 52 for charging the photosensitive drum 51, and a developing device 53 for developing an electrostatic latent image formed on the photosensitive drum 51 by toner particles supplied using a developing roller 54; a transfer unit comprising a transfer roller 61 provided opposite to the photosensitive drum 51 in order to transfer a toner image formed from the latent image by the image forming unit 5 on paper; a fixing unit 7 for heating and fixing the toner image transferred on the paper; and a paper conveying section 8 for delivering paper from a paper feeding cassette 81 by a paper feeding roller 82 and discharging the paper into a paper discharging section 1*a* provided near the center of the copying machine 1 by a rear-stage portion 8*b* including a conveying roller 84 from a front-stage portion 8*a* including a pair of registration rollers 83 through the image forming unit 5 and the fixing unit 7.

The image forming unit 5 has the above-mentioned photosensitive drum 51 in a cylindrical shape longitudinally extending and a covering member 55 covering an area above the photosensitive drum 51. The covering member 55 can bring the circumference of the photosensitive drum 51 into a dark state where the photosensitive drum 51 is not exposed to light, in a state where it is incorporated in the housing 10. Further, the covering member 55 has an opening 55*a* through which the light beam from the light irradiating unit 4 is to be passed. The opening 55*a* has approximately the same length as the length of the photosensitive drum 51, and horizontally extends. The opening 55*a* and the photosensitive drum 51 are spaced such that light can pass therebetween. The light beam is irradiated onto the circumference of the photosensitive drum 51 positioned between the charging corona discharger 52 and the developing device 53. The developing roller 54 and the charging corona discharger 52 are respectively provided, close to the photosensitive drum 51 which rotates in a counterclockwise direction in FIG. 1, at the lower left and above the photosensitive drum 51. The charging corona discharger 52 is obtained by stretching a high voltage wire to which a high voltage is applied over a frame-shaped member. The high voltage wire is provided in a direction parallel to the axis of the photosensitive drum 51.

In the charging corona discharger 52, ozone or a nitrogen oxide is generated by corona discharges. The ozone or the like may degrade the photosensitive drum 51. In the present embodiment, the photosensitive drum 51 can be prevented from being degraded by causing an air current to flow into an area surrounding the circumference of the photosensitive drum 51. Therefore, the copying machine 1 is provided with an air fan 11 for producing an air current and an air duct 12 for leading the air current from the air fan 11 to the image forming unit 5.

The foregoing will be described in detail below.

Figure 2:
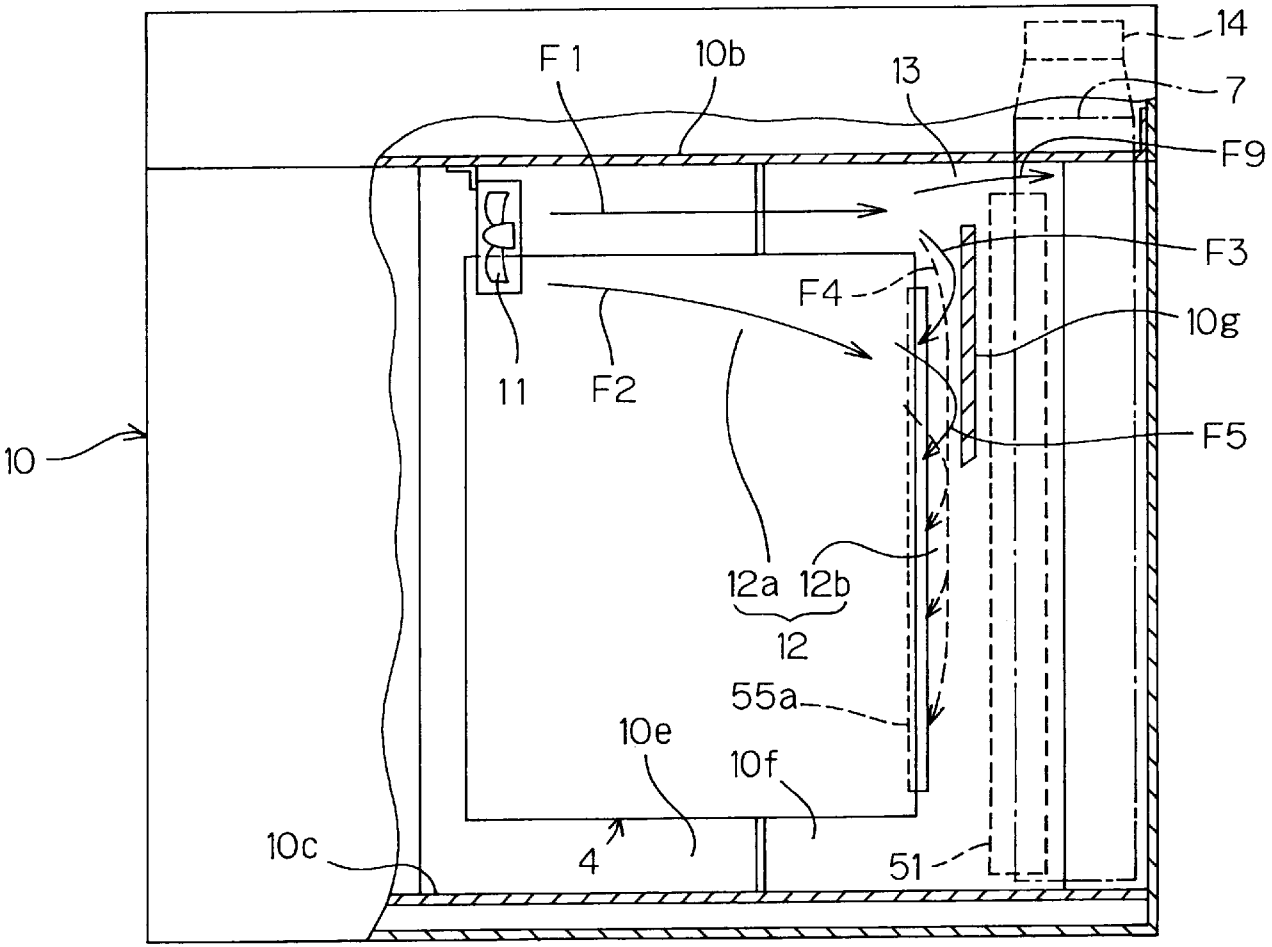
FIG. 2 is a plan view, partly in section, of the copying machine shown in FIG. 1, which illustrates a state where an upper plate portion of a housing is cut away.

FIG. 2 is a plan sectional view of the copying machine shown in FIG. 1, which illustrates a state where a part of the housing is cut away. FIGS. 1 and 2 will be referred to.

The air fan 11 is rotated by a motor 11*a*. Air is caused to flow into the housing 10 through an air inlet 10*a* formed in the housing 10, and is released into the air duct 12. The air inlet 10*a* is provided with a filter (not shown) for removing dust in air. The air fan 11 is arranged behind the light irradiating unit 4 inside the housing 10.

The housing 10 is shaped like a box, and has a rear plate 10*b* provided in a standing condition at its rear, a front plate 10*c* provided in a standing condition at its front parallel to the rear plate 10*b*, an upper plate 10*d* for connecting upper parts of the front plate 10*c* and the rear plate 10*b*, and supporting plates 10*e* and 10*f* positioned below the upper plate 10*d* for connecting the front plate 10*c* and the rear plate 10*b*.

The air fan 11, the image forming unit 5, the light irradiating unit 4, the fixing unit 7, and so forth, as described above, are mounted on each of the plates 10*b* to 10*f* of the housing 10. The light irradiating unit 4 is arranged near the center of the housing 10, to irradiate a light beam diagonally down to the right from its right end. The opening 55*a* of the image forming unit 5 and the photosensitive drum 51 are arranged on a path through which the light beam passes. The fixing unit 7 is arranged above the image forming unit 5 and on the right side of the light irradiating unit 4. The above-mentioned air duct 12 is defined in a clearance formed between each of the units and each of the plates 10*b* to 10*f* of the housing 10.

The air duct 12 has a first portion 12*a* connecting with the downstream side of the air fan 11 and causing air to flow almost rightward and leftward and a second portion 12*b* connecting with the downstream side of the first portion 12*a* and causing air to flow almost forward and backward. A branched air duct 13 connects with a rear part of the first portion 12*a* and a rear end of the second portion 12*b*. The branched air duct 13 causes air to flow almost rightward and leftward and leads the air to the fixing unit 7.

The first portion 12*a* has a rear part defined behind the light irradiating unit 4 (an air current flowing through the rear part is indicated by an arrow F1) and a front part defined above the light irradiating unit 4 (an air current flowing through the front part is indicated by an arrow F2).

The second portion 12*b* is formed directly above the opening 55*a*, is defined by a right side surface of the light irradiating unit 4, a supporting plate 10*f*, a lower surface of an upper plate 10*d*, a left side surface of the fixing unit 7, a rib 10*g* of the upper plate 10*d*, a front plate 10*c*, and a rear plate 10*b*, and longitudinally extends. The supporting plate 10*f* is provided with an opening at a position opposite to the opening 55*a*. An upper part of the second portion 12*b* and a front and right part of the first portion 12*a* communicate with each other. The rear end of the second portion 12*b* and the rear part of the first portion 12*a* communicate with each other. The rib 10*g* serving as an air guiding member is provided, facing to the rear part of the first portion 12*a*, at the rear end of the second portion 12*b*.

The rib 10*g* is provided between the fixing unit 7 and the light irradiating unit 4, and provided close by, above and on the right side of the opening 55*a*.

The rib 10*g* is provided on the upper plate 10*d*. The upper plate 10*d* has a main body portion having the above-mentioned paper discharging section 1*a* formed in an inclined shape on its upper surface. The rib 10*g* is formed, hanging on a lower surface of the main body portion. The rib 10*g* is formed in a flat plate shape so as to longitudinally extend parallel to the direction in which the opening 55*a* extends.

The rib 10*g* extends from the vicinity of the rear plate 10*b* to an approximately central part of the opening 55*a* in the longitudinal direction. A clearance to be a part of the branched air duct 13 is provided between a rear end of the rib 10*g* and the rear plate 10*b*, and an air current passing through the clearance leads to the fixing unit 7.

A suction fan 14 is provided behind the fixing unit 7 inside the housing 10. The suction fan 14 sucks air out of the fixing unit 7 and discharges the air from the copying machine. An air duct leading to the suction fan 14, the air duct 12 through which an air current from the air fan 11 is caused to flow, and the branched air duct 13 are partitioned from each other by the fixing unit 7. Consequently, the air current from the air fan 11 is prevented from flowing out as it is by the suction fan 14.

Operations will be described.

When the air fan 11 is driven, air flows in from the air inlet 10*a*. An air current from the air fan 11 flows from the left to the right in the first portion 12*a* of the air duct 12 (arrows F1 and F2), to lead to the second portion 12*b*. In the second portion 12*b*, a part of the air current flows forward in the direction in which the opening 55*a* extends along the rib 10*g*, a right side surface of the light irradiating unit 4, the supporting surface 10*f*, and so forth (an arrow F4), and the other part of the air current flows upon changing in direction such that it is directed toward the opening 55*a* by striking the rib 10*g* (arrows F3 and F5). The air current enters the image forming unit 5 through the opening 55*a* from the second portion 12*b*.

Figure 3:
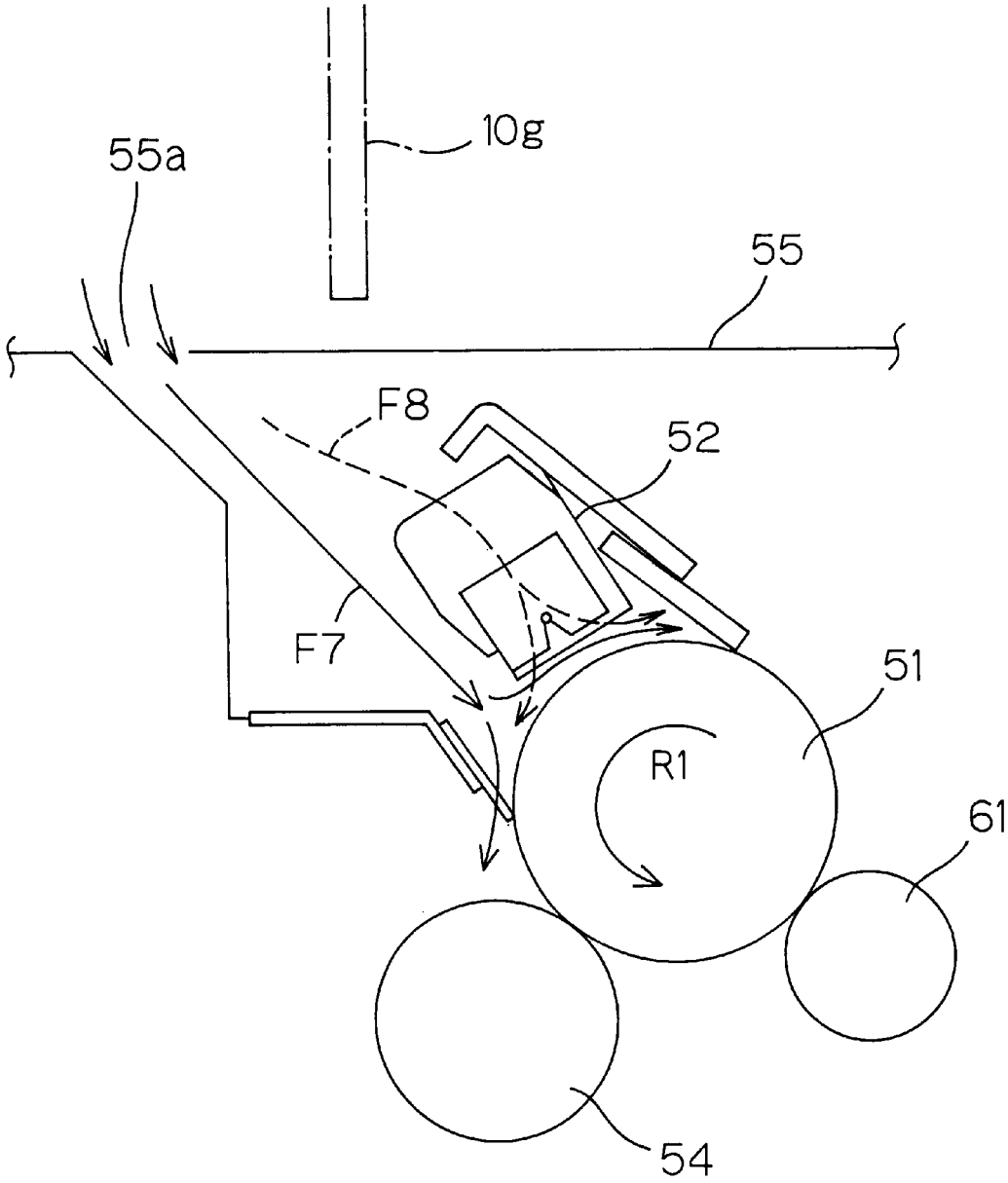
FIG. 3 is an enlarged front view of the inside of an image forming unit shown in FIG. 1.
Figure 4:
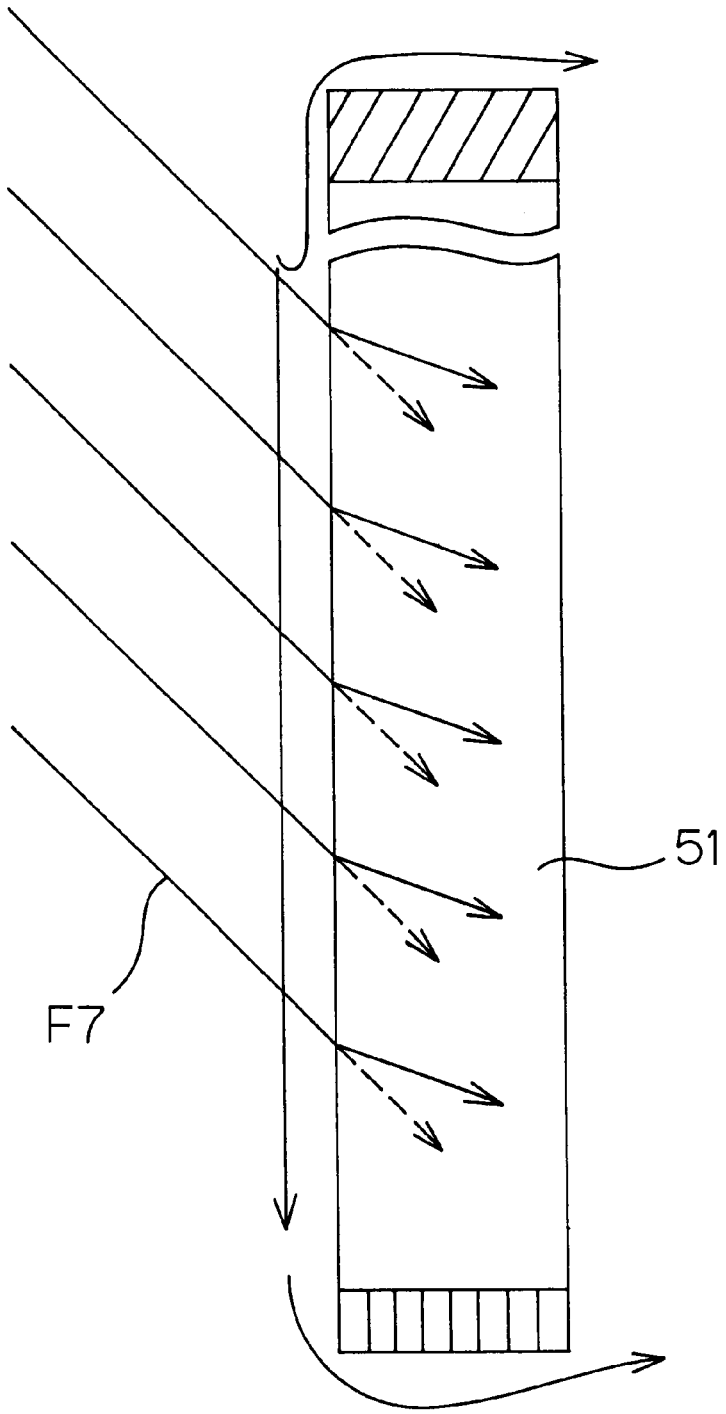
FIG. 4 is a plan view of a photosensitive drum shown in FIG. 1.

In the image forming unit 5, the air current flows along a path of a light beam, to smoothly lead to the circumference of the photosensitive drum 51 (an arrow F7), as indicated by an enlarged view of FIG. 3. The air current flows along the circumference of the photosensitive drum 51 in both directions along the circumference of the photosensitive drum 51 or in both directions along the axis of the photosensitive drum 51 (see Fig. 4), to blow off the ozone or the like out of an area surrounding the circumference.

The air current passes in the charging corona discharger 52 in the vicinity of the path of the light beam (an arrow F8 indicated by a broken line). At this time, the air current flows toward the photosensitive drum 51 from behind the charging corona discharger 52, to prevent silicon separated from toner particles from approaching the charging corona discharger 52.

At this time, the air current is subjected to a force in the direction of rotation of the photosensitive drum 51 (an arrow R1). Accordingly, the air current flows without staying in the vicinity of the charging corona discharger 52.

The air current which has passed through the photosensitive drum 51 is diffused into the housing 10, and is released from the copying machine.

The air current leads to the fixing unit 7 from the rear part of the first portion 12*a* of the air duct 12 through the branched air duct 13, to cool the fixing unit 7 (an arrow F9 in FIG. 2).

According to the present embodiment, an air current is thus caused to flow into the area surrounding the circumference of the photosensitive drum 51. Consequently, ozone or a nitrogen oxide generated by the charging corona discharger 52 is diffused outward from the area surrounding the photosensitive drum 51, so that the concentration of the ozone or the like in the area surrounding the photosensitive drum 51 can be decreased. As a result, the photosensitive drum 51 can be prevented from being degraded by the ozone or the like.

Particularly, the air current flows in through the opening 55*a*. Accordingly, the air current can smoothly lead to the circumference of the photosensitive drum 51 and the vicinity of the charging corona discharger 52. As a result, the ozone or the like can be effectively dispersed immediately after it is generated.

Since both an inlet for a light beam and an inlet for an air current share the opening 55*a*, the construction of the copying machine can be made simpler, as compared with that in a case where the inlets are separately provided in the covering member 55.

When the air current is sucked in from the area surrounding the photosensitive drum 51, the construction of the copying machine must require high airtightness in order to increase the suction efficiency, so that the construction of the copying machine becomes complicated. Moreover, the size of the air fan 11 must be made large. On the other hand, in the present embodiment, the airtightness of the construction of the covering member 55 and the like need not be increased. Moreover, even if the air current in a case where the ozone or the like is dispersed is weaker than that in a case where it is sucked in, the concentration of the ozone or the like can be sufficiently decreased. Accordingly, the air fan 11 can be miniaturized. As a result, the copying machine can be fabricated in simple construction.

By providing the air duct 12, it is possible to increase the degree of freedom of the arrangement of the air fan 11, arrange the air fan 11 in a vacant space, and prevent the whole construction of the copying machine from being complicated.

When the rib 10*g* serving as an air guiding member is provided, the air current can be reliably guided to the opening 55*a*. Accordingly, the concentration of the ozone or the like can be efficiently decreased, thereby making it possible to more reliably prevent the photosensitive drum 51 from being degraded. Moreover, if the rib 10*g* is formed integrally with the upper plate 10*d* serving as another member, the construction of the copying machine can be prevented from being complicated.

Examples of the air guiding member may be one extending in the direction in which an air current is guided, for example, the above-mentioned rib 10*g*, and one arranged in a direction crossing the air current for changing the direction of the air current.

Particularly, it is preferable that the air guiding member is provided in a part, near the air fan 11 and on the upstream side of the air current, of an air duct just ahead of the opening 55*a*, to direct the air current toward a part of the opening 55*a* in the vicinity of the air duct part. Consequently, the variation in the air current to the photosensitive drum 51 can be reduced. The reason for this is that the opening 55*a* has a shape which is long in one direction, and the light irradiating unit 4 is arranged opposite to the opening 55*a*. In such an arrangement, the air current flowing through the air duct 12 also flows along the length of the opening 55*a* in the vicinity of the opening 55*a*. Accordingly, the air current varies along the axis of the photosensitive drum 51.

For example, the values of the concentration of ozone and the concentration of a nitrogen oxide at each position in the circumference of the photosensitive drum 51 in a case where the rib 10*g* is provided (see Table 1) are compared with those in a case where the rib 10*g* is not provided (see Table 2). Each of Table 1 and Table 2 expresses, at each of two positions along the circumference of the photosensitive drum 51 (a position in the vicinity of the charging corona discharger and a position in the vicinity of the transfer roller), the respective values of the concentration of the ozone and the concentration of the nitrogen oxide by respective values at three positions (the front, the center, and the rear) along the axis of the photosensitive drum 51 and their average value. By providing the rib 10*g*, the respective variations in the values of both the concentrations of the ozone and the nitrogen oxide along the axis of the photosensitive drum 51 are reduced. The maximum value and the average value of each of the concentrations are decreased. The respective values in Table 1 and Table 2 are such values that the photosensitive drum 51 is not degraded, so that there is no problem.

TABLE 1

| | $O_3$ concentration (ppm) | | $No_x$ concentration (ppm) | |
|---|---|---|---|---|
| | charging corona discharger | transfer roller | charging corona discharger | transfer roller |
| front | 1.994 | 0.261 | 0.453 | 0.129 |
| center | 1.460 | 0.750 | 0.353 | 0.180 |
| rear | 1.092 | 0.545 | 0.211 | 0.151 |
| average | 1.515 | 0.519 | 0.339 | 0.153 |

amount of air: 0.5 $m^3$/min
there is rib

TABLE 2

| | $O_3$ concentration (ppm) | | $No_x$ concentration (ppm) | |
|---|---|---|---|---|
| | charging corona discharger | transfer roller | charging corona discharger | transfer roller |
| front | 1.230 | 0.858 | 0.313 | 0.278 |
| center | 6.564 | 0.752 | 1.132 | 0.113 |
| rear | 3.920 | 0.566 | 0.621 | 0.217 |
| average | 3.905 | 0.725 | 0.689 | 0.203 |

amount of air: 0.5 $m^3$/min
there is no rib

When silicon is included in toner particles, such a phenomenon that the silicon adheres to the charging corona discharger 52 may, in some cases, occur. If the phenomenon occurs, there are possibilities of abnormal discharges and degradation of an image. Contrary to this, in the present embodiment, the air current can be caused to flow in a direction toward the photosensitive drum 51 from behind the photosensitive drum 51 such that the silicon separated from the toner particles is moved away from a high voltage wire. Accordingly, the above-mentioned phenomenon can be reliably prevented. Moreover, the charging corona discharger 52 is positioned in the vicinity of the path of the light beam from the opening 55*a,* so that the air current can efficiently flow into the charging corona discharger 52. As a result, the present embodiment is preferable to preventing the above-mentioned phenomenon.

As described above, the photosensitive drum 51 can be prevented from being degraded by the ozone or the like. Accordingly, the life of the photosensitive drum 51 can be lengthened. Moreover, when the silicon is included in the toner particles, such a phenomenon that the silicon adheres to the charging corona discharger 52 can be also prevented. Consequently, it is possible to form a good image more stably for a long time.

Furthermore, the air fan 11 is also used for cooling the fixing unit 7. Accordingly, the construction of the copying machine can be simplified.

The arrangement and the construction of the air fan 11 and the air duct 12 in the copying machine are not limited to the foregoing, provided that the air current can be caused to flow through the opening 55*a*.

Although the above-mentioned image forming apparatus is applied to the copying machine, it may be applied to a printer, a facsimile, or the like. The present invention is also applicable to the construction of an image forming apparatus, provided that an electrostatic latent image is formed upon directing light to the charged photosensitive drum 51 through the opening 55.

In addition thereto, various design changes can be made in the range in which the gist of the present invention is not changed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:

a housing;

a photosensitive drum;

a charging corona discharger for inducing corona discharges in order to charge the circumference of the photosensitive drum;

a covering member for covering the photosensitive drum in a state where the photosensitive drum is not exposed to light;

an opening formed in the covering member and capable of directing a light beam corresponding to an image to be formed to the photosensitive drum;

an air fan for blowing air to generate an air current;

an air duct for conducting the air current generated by the air fan to the opening; and a guiding member for guiding the air current such that the air current flows into an area surrounding the photosensitive drum through the opening;

wherein, before being exhausted from the image forming apparatus, the air from the air current is diffused into the housing after exiting the area surrounding the photosensitive drum.

* * * * *